US005493950A

United States Patent [19]

Kim

[11] Patent Number: 5,493,950

[45] Date of Patent: Feb. 27, 1996

[54] VARIABLE PRIORITY DEVICE FOR SWING MOTOR IN HEAVY CONSTRUCTION EQUIPMENT

[75] Inventor: Jin-Wook Kim, Changwon-Shi, Rep. of Korea

[73] Assignee: Samsung Heavy Industry Co. Ltd., Rep. of Korea

[21] Appl. No.: 323,146

[22] Filed: Oct. 14, 1994

[30] Foreign Application Priority Data

Dec. 30, 1993 [KR] Rep. of Korea ..... 1993-31451

[51] Int. Cl.[6] ..... F15B 11/00; F16D 31/02

[52] U.S. Cl. ..... 91/516; 91/461; 60/426; 60/494; 60/468

[58] Field of Search ..... 60/422, 426, 468, 60/494; 91/515, 516, 461, 529

[56] References Cited

U.S. PATENT DOCUMENTS

| | | | |
|---|---|---|---|
| 4,230,022 | 10/1980 | Bianchetta et al. | 91/516 |
| 4,343,151 | 8/1982 | Lorimor | 91/516 X |
| 4,479,349 | 10/1984 | Westveer | 60/422 X |
| 5,201,176 | 4/1993 | Oshima | 91/516 X |

FOREIGN PATENT DOCUMENTS

| | | | |
|---|---|---|---|
| 4149326 | 5/1992 | Japan | 91/529 |

*Primary Examiner*—Edward K. Look
*Assistant Examiner*—Hoang Nguyen
*Attorney, Agent, or Firm*—Lieberman & Nowak

[57] ABSTRACT

A variable priority device for a swing motor in heavy construction equipment including a variable orifice device installed in an arm cylinder-side parallel oil passage of an parallel oil passage for supplying oil pumped by a single pump to a swing motor and an arm cylinder, the variable orifice device serving to perform a switching operation between an orifice state and an orifice release state in response to a pilot pressure for moving the spool of a swing motor control switching valve. The variable orifice device includes a check valve disposed in the arm cylinder-side parallel oil passage and provided with a spring chamber and a spool resiliently supported in the spring chamber by a spring exerting a predetermined pressure such that the spool maintains an initial state for closing the arm cylinder-side parallel oil passage, the spool having an internal oil passage for performing an orifice function, and a cutoff valve connected to the spring chamber via an oil discharge passage and adapted to perform a switching operation for selectively opening and closing the oil discharge passage in response to the pilot pressure.

2 Claims, 3 Drawing Sheets

Fig. 1
(PRIOR ART)
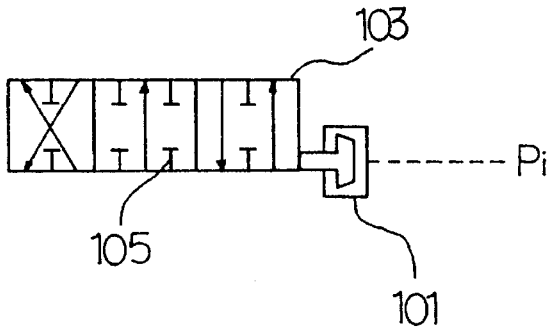
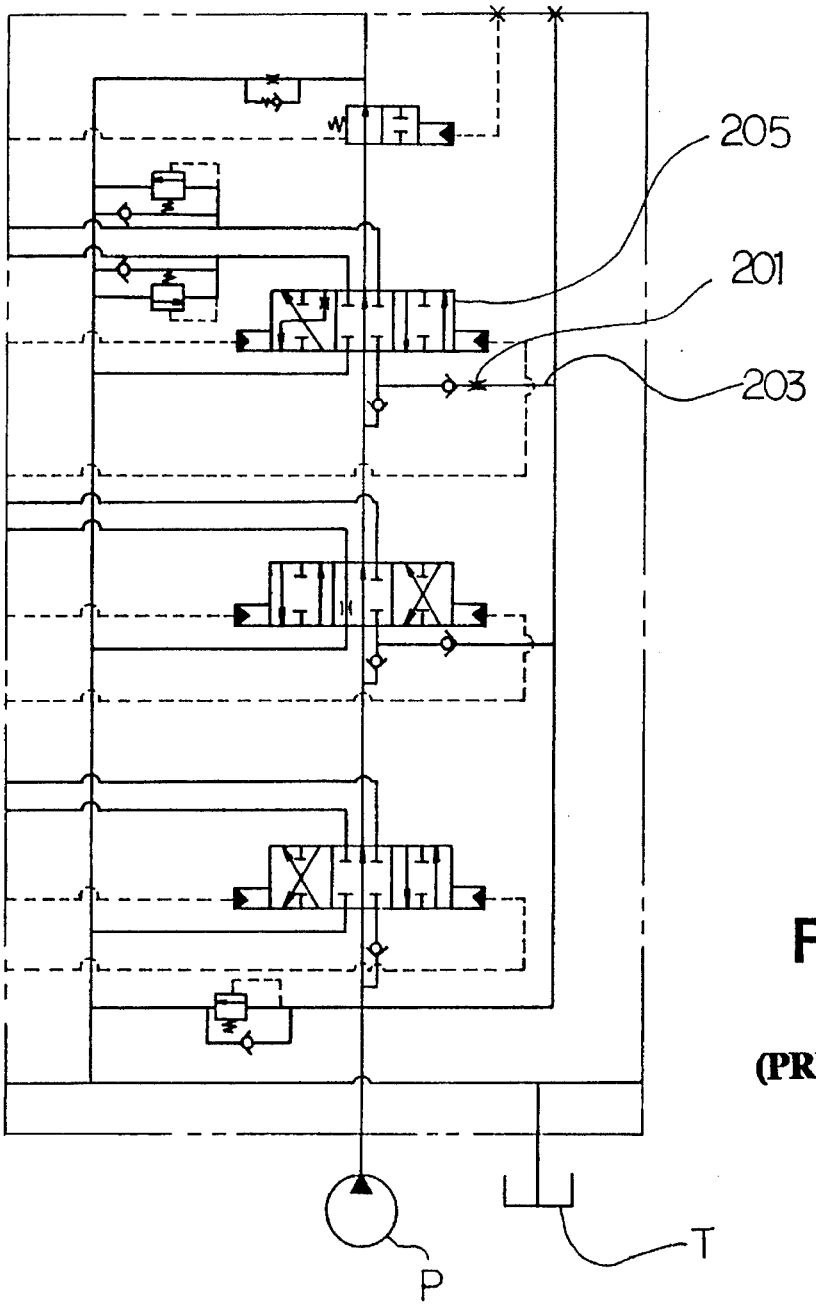
Fig. 2
(PRIOR ART)

Fig. 4(A)
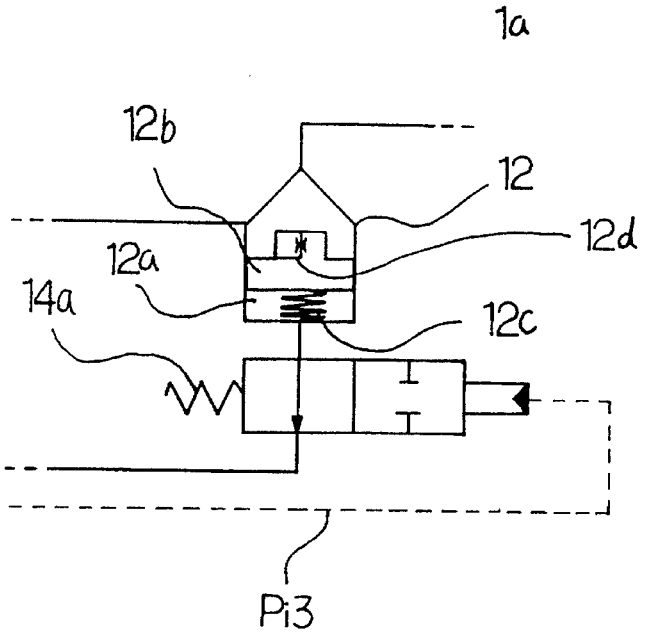
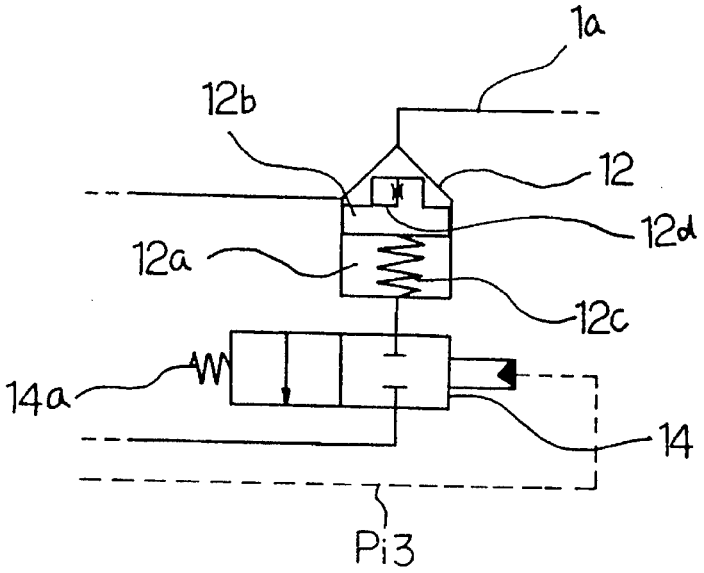
Fig. 4(B)

VARIABLE PRIORITY DEVICE FOR SWING MOTOR IN HEAVY CONSTRUCTION EQUIPMENT

BACKGROUND OF THE INVENTION

1. Field of the Invention

The present invention relates to a hydraulic apparatus for a heavy construction equipment, and more particularly to a variable priority device for a swing motor in a heavy construction equipment.

2. Description of the Prior Art

Where at least two actuators are operated by a single pump, a "priority" is established to control the actuators such that one of the actuators is supplied with a larger amount of oil than the other actuator. For example, in an excavator wherein a swing actuator, namely, a swing motor, and an arm actuator, namely, an arm cylinder are supplied with operating oil from a single pump, the amount of oil required for swing operation is considerably larger than the amount of oil required for an arm operation. To this end, a priority is assigned to the swing motor by limiting the amount of oil supplied to the arm cylinder and increasing the amount of oil supplied to the swing motor by the limited amount of off. Such a relationship is also applied to a case wherein a boom should have priority over a bucket.

Meanwhile, a stroke limiter or an orifice is conventionally used to provide the above-mentioned priority function. In the case illustrated in FIG. 1, wherein the stroke limiter 101 is used, the stroke limiter 101 is equipped in an arm cylinder control valve 103 to limit a spool stroke of the arm cylinder control valve 103 within a certain range, thereby preventing a supply oil passage 105 defined in the valve 103 from being fully opened. In the case illustrated in FIG. 2, wherein the orifice 201 is used, the orifice 201 is disposed in an arm cylinder-side parallel oil passage 203 to limit the amount of oil supplied to an arm cylinder control valve 205.

In either case, namely, where the supply oil passage defined the arm cylinder control valve is prevented from being fully opened by the stroke limiter, or where the arm cylinder-side parallel oil passage is limited on the oil amount passing therethrough by the orifice, the amount of oil supplied to the arm cylinder is reduced, while the limited amount of oil is additionally supplied to the other actuator, namely, the swing motor. As a result, the swing motor has priority over the arm cylinder.

However, the above-mentioned conventional devices have a problem in that the oil passage is always limited to the amount of oil passing therethrough when there is only one actuator in operation, or a combined operation of both actuators. In other words, although the swing motor desirably has priority over the arm cylinder by the function of the stroke limiter or orifice when both the swing motor and the arm cylinder operate in a combined manner, the arm cylinder-side oil passage is also limited undesirably on the amount of oil passing therethrough even when the arm cylinder operates alone. In the latter case, limiting the oil amount passing the arm cylinder-side oil passage results in various problems such an unnecessary loss of pressure, heat generation caused by overload and a decrease in the operating speed of the arm.

SUMMARY OF THE INVENTION

Therefore, an object of the invention is to provide a variable priority device for a swing motor in a heavy construction equipment capable of supplying a sufficient amount of oil to an arm cylinder of the heavy construction equipment when the arm cylinder operates alone, by releasing an orifice function, while decreasing the amount of oil supplied to the arm cylinder and relatively increasing the amount of oil supplied to a swing motor of the heavy construction equipment by the orifice function, thereby enabling the swing motor to have variable priority over the arm cylinder.

In accordance with the present invention, this object can be accomplished by providing in a hydraulic apparatus for heavy construction equipment adapted to supply oil pumped by a single pump to a swing actuator and an arm actuator respectively via parallel oil passages, a variable priority device for the swing actuator comprising means for limiting the amount of oil passing through the arm actuator-side parallel oil passage during operation of the swing actuator and thereby decreasing the amount of oil supplied to the arm actuator.

In accordance with a desirable aspect of the present invention, the oil amount limiting means comprises a variable orifice means installed in the arm actuator-side parallel oil passage and is adapted to perform a switching operation between an orifice state and an orifice release state in response to a pilot pressure for moving the spool of a swing actuator control valve connected to the swing actuator.

BRIEF DESCRIPTION OF THE DRAWINGS

Other objects and aspects of the invention will become apparent from the following description of embodiments with reference to the accompanying drawings in which:

FIG. 1 is a hydraulic circuit diagram illustrating a stroke limiter installed in an arm cylinder control valve for establishing a priority function for a swing motor in the conventional manner;

FIG. 2 is a hydraulic circuit diagram illustrating an orifice installed in an arm cylinder control valve for establishing a priority function for a swing motor in the conventional manner;

FIGS. 4A and 4B are partial hydraulic circuit diagrams respectively illustrating different states of the variable priority device for the swing motor shown in FIG. 3, wherein FIG. 4A shows an orifice release state, while FIG. 4B shows an orifice state.

PREFERRED EMBODIMENTS OF THE INVENTION

Figure 3:
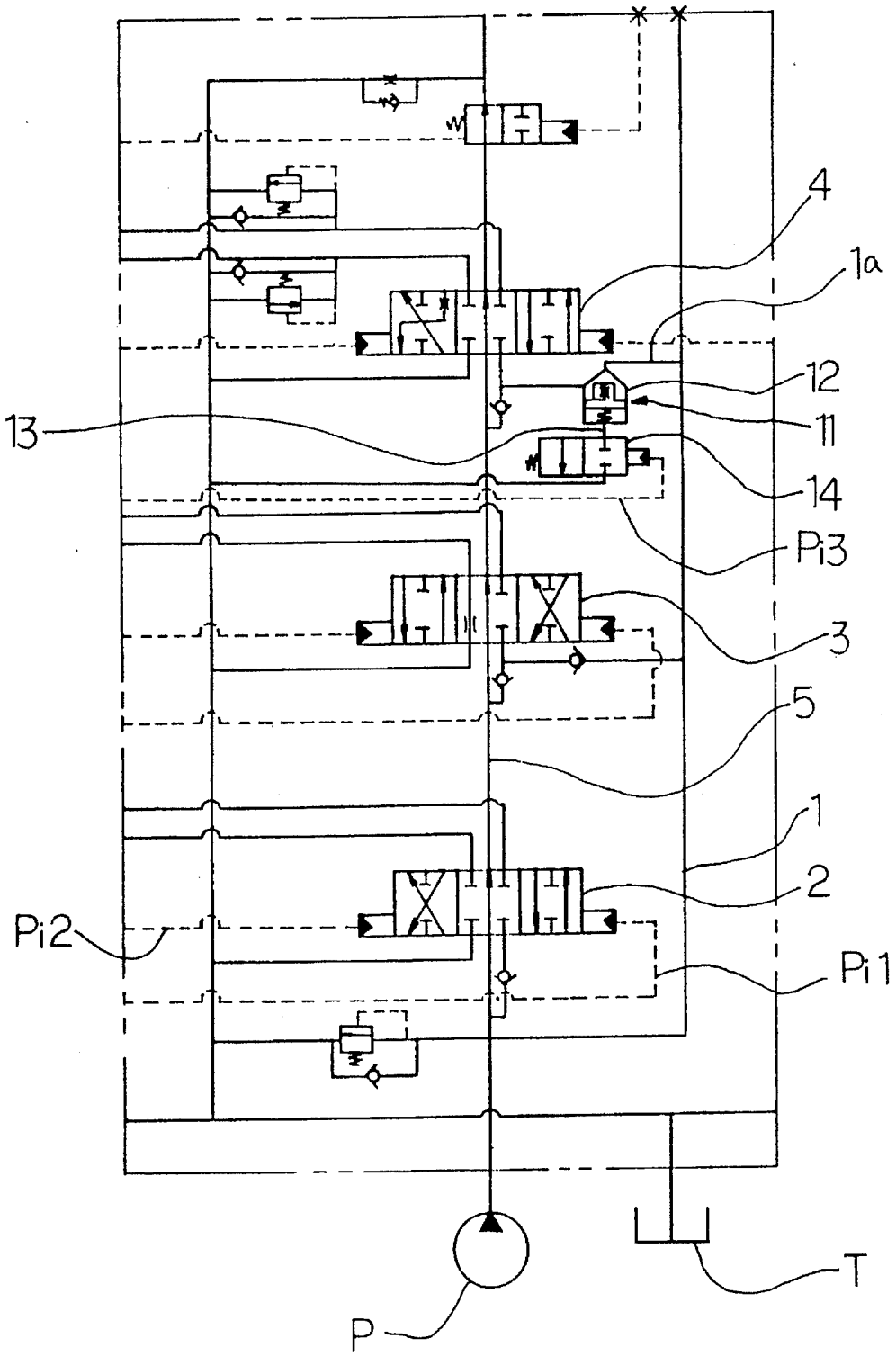
FIG. 3 is a hydraulic circuit diagram illustrating a variable priority device for a swing motor in accordance with an embodiment of the present invention.

Referring to FIG. 3 and FIGS. 4A and 4B, there is illustrated a variable priority device for a swing motor in a heavy construction equipment in accordance with an embodiment of the present invention.

In the heavy construction equipment shown in FIG. 3 and FIGS. 4A and 4B, oil pumped by a single pump P is supplied to a plurality of actuators (not shown) in an independent or combined manner via a parallel oil passage 1. The reference numeral 2 denotes a control valve for supplying the oil to a swing actuator, namely, a swing motor, a control valve 3 for supplying the oil to a travel actuator, namely, a travel motor, and 4 a control valve for supplying the oil to an arm actuator, namely, an arm cylinder. When all the control valves 2, 3 and 4 are maintained in their neutral positions, respectively, the pumped oil from the pump P is returned directly to a tank T via a center bypass passage 5.

Provided in an arm cylinder-side parallel oil passage 1*a* connected between the parallel oil passage 1 and the arm cylinder is means 11 for limiting the amount of oil passing through the arm cylinder-side parallel oil passage 1 a during operation of the swing motor and thereby decreasing the amount of oil supplied to the arm cylinder. The means 11 may comprise a variable orifice device adapted to sense the operation of the swing motor, namely, a pilot pressure for moving the spool of the swing motor control valve 2 and to perform its switching between an orifice state and an orifice release state.

In other words, the variable orifice device includes a check valve 12 disposed in the arm cylinder-side parallel oil passage 1*a* and a cutoff valve 14 connected to a spring chamber 12*a* via an oil discharge passage 13 and adapted to perform its switching operation for selectively opening and closing the oil discharge passage 13.

In the spring chamber 12*a* of check valve 12, a spool 12*b* is resiliently supported by means of a spring 12*c* exerting a predetermined pressure such that it is maintained at its initial state for closing the arm cylinder-side parallel oil passage 1*a*. The spool 12*b* has an internal oil passage 12*d* for performing an orifice function.

When hydraulic pressure is exerted in the arm cylinder-side parallel oil passage 1*a*, the spool 12*b* is moved against the resilient force of the spring 12*c* in a downward direction when viewed in FIG. 4A. As a result, the arm cylinder-side parallel oil passage 1*a* is fully opened, so that oil may be normally supplied to the arm cylinder control valve 4 in a sufficient amount, as shown in FIG. 4A. Where the spool 12*b* can not move downwards due to a reason that will be described hereinafter, however, the internal oil passage 12*d* of spool 12*b* performs the orifice function, thereby decreasing the amount of oil supplied to the arm cylinder-side switching valve 4 via the arm cylinder-side parallel oil passage la, as shown in FIG. 4B.

On the other hand, the cutoff valve 14 is switched to open or close the oil discharge passage 13 in accordance with the movement of a spool disposed therein. The spool of cutoff valve 14 has an initial position set to maintain the oil discharge passage 13 at its opened state by virtue of a spring 14*a*. The movement of the spool in the cutoff valve 14 is achieved by the pilot pressure for moving the spool of swing motor control valve 2. In other words, pilot lines Pi1 and Pi2 of the swing motor control valve 2 are connected to a pilot line Pi3 of the cutoff valve 14. As a result, when the pilot pressure for moving the spool of swing motor control valve 2 is generated to carry out the operation of the swing motor, it is transmitted to the spool of the cutoff valve 14 via one of the pilot lines Pi1 or Pi2 and line Pi3, so that the spool of cutoff valve 14 moves to the left when viewed in FIG. 4B, thereby causing the oil discharge passage 13 to be closed.

When the oil discharge passage 13 is closed, the spool 12*b* of check valve 12 can not move downwards even if hydraulic pressure is exerted in the arm cylinder-side parallel oil passage 1*a*. This is because no oil may be discharged out of the spring chamber 12*a* of check valve 12 via the oil discharge passage 13. As a result, the oil in arm cylinder-side parallel oil passage 1*a* is fed to the arm cylinder control switching valve 4 via the internal oil passage 12*d* of spool 12*b* in a decreased amount, by virtue of the orifice function of the internal oil passage 12*d*.

Consequently, a priority of the swing motor over the arm cylinder is established because the amount of oil supplied to the swing motor via the swing motor control valve 2 is increased by the amount of oil decreased due to the orifice function.

As apparent from the above description, in accordance with the present invention, it is possible to variably adjust the arm cylinder-side parallel oil passage such that the orifice function is exerted and released selectively in accordance with the fact of whether the operation of swing motor is carried out, namely, whether the pilot pressure for moving the spool of swing motor-side switching valve is generated. Accordingly, the priority of the swing motor over the arm cylinder is established by the orifice function during the combined operation of the swing motor and arm cylinder, whereas the orifice function is released during the operation of the arm cylinder alone so that oil may be normally supplied to the arm cylinder-side in a sufficient amount.

By virtue of the variable orifice function of the present invention, consequently, it is possible to avoid the problems encountered in the conventional priority device for the swing motor, namely, the loss of oil pressure occurring during the operation of the arm cylinder alone and the generation of heat caused by an overload, and considerably increasing the operation speed of the arm.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. In a hydraulic apparatus for heavy construction equipment adapted to supply oil pumped by a single pump to a swing actuator and an arm actuator respectively via parallel oil passages, a variable priority device for the swing actuator comprising means for limiting the amount of oil passing through the arm actuator side parallel oil passage during operation of the swing actuator and thereby decreasing the amount of oil supplied to the arm actuator, said limiting means comprising a variable orifice means installed in the arm actuator side parallel oil passage and adapted to perform a switching operation between an orifice state and a orifice release state in response to a pilot pressure for moving a spool of a swing actuator control valve connected to the swing actuator.

2. The variable priority device in accordance with claim 1, wherein the variable orifice means comprises:

a check valve disposed in the arm actuator-side parallel oil passage and provided with a spring chamber and a spool resiliently supported in the spring chamber by a spring exerting a predetermined pressure such that the resiliently mounted spool maintains an initial state for closing the arm actuator-side parallel oil passage, the resiliently mounted spool having an internal oil passage for performing an orifice function; and a cutoff valve connected to the spring chamber via an oil discharge passage and adapted to perform a switching operation for selectively opening and closing the oil discharge passage in response to the pilot pressure for moving the spool of the swing actuator control valve.

* * * * *